United States Patent [19]

Welbon

[11] 4,357,844

[45] Nov. 9, 1982

[54] UNIDIRECTIONAL DRIVE HAND OPERATED WRENCH

[76] Inventor: Harold Welbon, 7980 Clovernook Ave., Mt. Healthy, Ohio 45231

[21] Appl. No.: 178,726

[22] Filed: Aug. 18, 1980

[51] Int. Cl.[3] ..... B25B 13/46

[52] U.S. Cl. ..... 81/57.39; 81/57.31

[58] Field of Search ..... 81/57.29, 57.39, 57.31; 74/812

[56] References Cited

U.S. PATENT DOCUMENTS

| | | | |
|---|---|---|---|
| 1,262,772 | 4/1918 | Giliberti | 74/812 |
| 1,860,914 | 5/1932 | Wellman | 81/57.31 |
| 2,520,443 | 8/1950 | Seaquist . | |
| 2,641,136 | 6/1953 | Marsden, Jr. et al. | 81/57.31 |
| 3,477,318 | 11/1969 | Batten . | |

*Primary Examiner*—James L. Jones, Jr.
*Attorney, Agent, or Firm*—Frost & Jacobs

[57] ABSTRACT

A hand operated wrench in which the driver head is rotated in the same direction regardless of the direction of movement of the wrench handle. In a first embodiment, the wrench includes nested handles operating bevel gears having shiftable pawls for reversing the direction of rotation of the driver head. In a second embodiment, the wrench includes clustered spur gears having individually operated pawls for reversing the direction of rotation of the driver head.

9 Claims, 8 Drawing Figures

UNIDIRECTIONAL DRIVE HAND OPERATED WRENCH

SUMMARY OF THE INVENTION

The use of reversible ratchet wrenches for tightening and loosening bolts associated with threaded fasteners is well-known in the art and has been the subject of many designs. With such devices, there is usually a degree of lost motion when the operating handle is moved in a direction opposite to the drive direction under the influence of a pawl or ratchet arrangement in order to begin a new driving stroke. In some instances, the additional movement associated with the return stroke has been found cumbersome and objectionable as where the wrench must be operated in tight quarters, for example. Furthermore, the lost motion associated with the return stroke prevents the full utilization of the mechanical advantage of the wrench.

The present invention is directed to a hand operated wrench in which the driver head is rotated in the same direction regardless of the direction of movement of the wrench handle. Consequently, torque may be applied to the nut or fastener during both the forward and return strokes of the wrench.

In a first embodiment, the wrench of the present invention comprises a U-shaped handle having a pair of spaced arms. A toothed driver bevel gear is rotatably secured to the inner surface of each of the handle arms by means of a support shaft such that the gears are in spaced facing relationship. A socket stud or fitting is connected to one of the driver gears coaxially with the support shaft for rotation therewith. An elongated driver member is rotatably secured at one end to the support shaft between the driver gears. A pair of spaced toothed bevel pinion gears are rotatably secured to the driver member such that they mesh with each of the driver gears. The opposite end of the driver member terminates in a gripping handle such that the gripping handle fits between the spaced arms of the U-shaped handle when the handles are colinear with each other, the handles being angularly displaceable with respect to each other. A pawl associated with each of the driver gears is secured to each of the U-shaped handle arms. One of the pawls permits rotation of the associated driver gear in only one direction while the other of the pawls permits rotation of the associated driver gear in only the opposite direction. The pawls are displaceable for reversing the permitted direction of rotation of the driver gears. As will be explained in more detail hereinafter, angular displacement between the handles in either direction causes the drive stud, which may have a standard socket attached to it, to rotate in only a single direction. Displacement of the pawls reverses the direction of rotation of the unidirectional drive stud.

In a second embodiment, the wrench of the present invention includes a first elongated handle mounting first and second independently rotatable overlying coaxial driver spur gears. A movable pawl is associated with each of the spur gears, one of the pawls permitting rotation of its associated spur gear in only one direction while the other of the pawls permits rotation of its associated spur gear in only the opposite direction. The pawls are displaceable for reversing the permitted direction of rotation of the associated spur gear. A second handle is pivotally connected to the first handle and rotatably mounts first and second coaxial driven spur gears. The first driven spur gear meshes with the first driver gear. The wrench also includes spaced first and second idler spur gears rotatably mounted to the second handle which mesh with the second driver spur gear and the second driven spur gear. A drive stud is connected to the driver gears for rotation therewith. Relative angular displacement between the handles in either direction causes the drive stud to rotate in only a single direction. The pawls may be reversed to reverse the unidirectional motion of the drive stud.

Further features of the invention will become apparent from the detailed description which follows.

DETAILED DESCRIPTION

Figure 1:
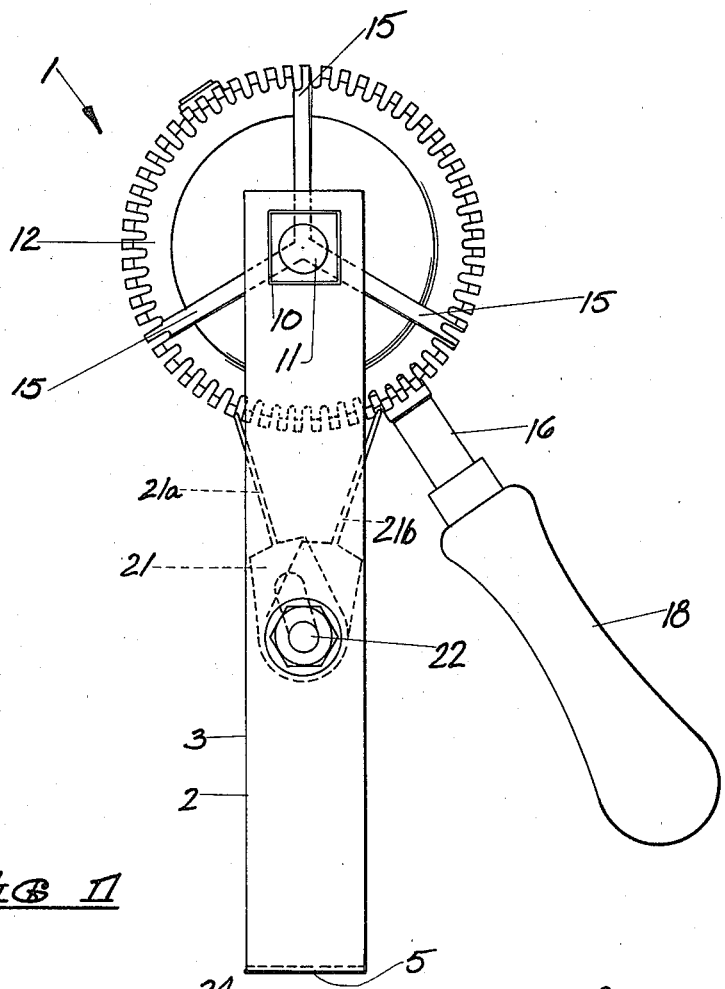
FIG. 1 is a top plan view of a first embodiment of the unidirectional drive wrench of the present invention with the drive handle illustrated in an operative position, and the upper pawl illustrated in alternate positions.

A first embodiment of the unidirectional drive hand operated wrench of the present invention is illustrated generally at 1 in FIG. 1. The wrench includes a strip-like U-shaped handle 2 having a pair of generally parallel spaced arms 3 and 4 connected at their lower ends by an arcuate portion 5. Handle 2 may be constructed of any suitable material such as metal, plastic or the like.

Figure 2:
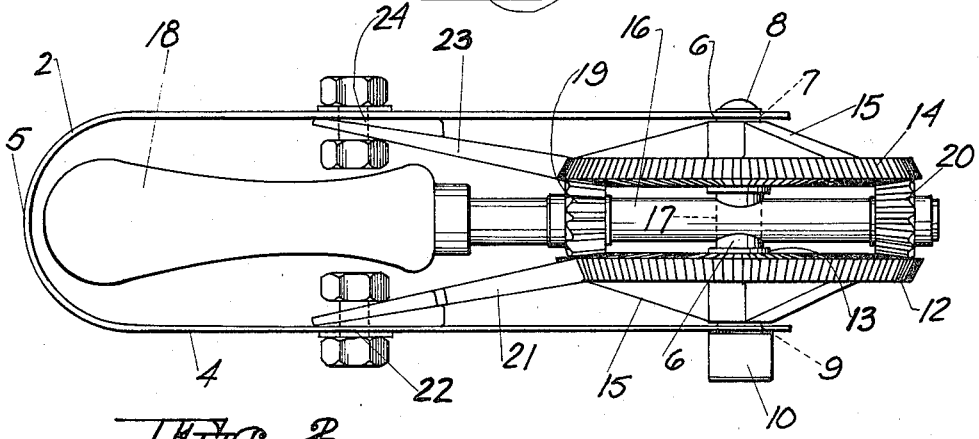
FIG. 2 is a side elevation view of the wrench of FIG. 1 rotated 90°.

The upper ends of arms 3 and 4 rotatably support the ends of transversely extending generally cylindrical support shaft 6. As best shown in FIG. 2, one end of shaft 6 passes through a cooperating hole 7 in arm 3, with the end of shaft 6 being flared as at 8 to hold the shaft in place. The opposite end of shaft 6 passes through a similar opening 9 in arm 4 and terminates in a generally square drive means or drive stud 10 containing a central opening or aperture 11 configured to accept and mate with a conventional sockethead or the like as is well-known in the art. It will be understood that opening 9 may also be provided with a bearing or bushing, as required, to provide a rotatable mount between arm 4 and shaft 6.

A first toothed driver bevel gear 12 is non-rotatably secured to shaft 6 as at 13. Consequently, bevel gear 12 and drive stud 10 will rotate together as a unit. A second toothed driver bevel gear 14 is rotatably secured to shaft 6 in spaced facing relationship to gear 12. Each of gears 12 and 14 may be provided with supporting radially disposed ribs 15 to increase the mechanical integrity of the gears. It will be understood that this arrangement permits bevel gears 12 and 14 to rotate independently of each other.

An elongated driver member 16 is positioned between bevel gears 12 and 14, and is rotatably secured to shaft 6 as at 17. This construction permits driver member 16 to rotate on shaft 6 independently of the rotation of gears 12 and 14. The opposite end of driver member 16 terminates in a gripping handle 18 such that the gripping handle fits between spaced arms 3 and 4 of handle 2 when the handles are co-linear with each other. Gripping handle 18 is configured to be easily grasped by the hand for applying rotary motion.

A toothed bevel pinion gear 19 and 20, respectively, is rotatably secured to driver member 16 on either side of shaft 6 such that the pinion gears mesh with each of the driver bevel gears 12 and 14. In general, securement between pinion gears 19 and 20 and driver member 16 will be such as to prevent axial movement of the gears on the driver member shaft.

A movable pawl 21 is secured to arm 4 as at 22. The outermost end of pawl 21 is in contact with the teeth of driver bevel gear 12. As best shown in FIG. 1, pawl 21 is shiftable between a first position 21*a* in which the pawl permits rotation of driver bevel gear 12 in a clockwise direction but prevents rotation of the gear in a counter-clockwise direction, and a second position indicated at 21*b* where movable pawl 21 permits rotation of driver bevel gear 12 in a counter-clockwise direction but prevents rotation of the gear in a clockwise direction.

A similar movable pawl 23 is shiftably secured to arm 3 as at 24 with the outermost end of the pawl being in contact with the teeth of driver bevel gear 14. It will be observed as best shown in FIG. 2 that the contacting ends of pawls 21 and 23 lie on opposite sides of the central axis of shaft 6, thereby constraining driver bevel gear 12 to rotate in one direction and driver bevel gear 14 to rotate in the opposite direction. Pawls 21 and 23 may be displaced to permit relative rotation of the driver bevel gears in the opposite direction.

As illustrated in FIG. 1, positioning of pawl 21 in the position designated 21*b* permits drive stud 10 to be rotated in a counter-clockwise direction for tightening a typical nut or bolt (not shown). In this configuration, rotation of U-shaped handle 2 in a clockwise direction causes pawl 23 to engage driver bevel gear 14 to rotate driver bevel gear 12 and consequently drive stud 10 in a counter-clockwise direction. At the end of this driving stroke, when U-shaped handle 2 is rotated in a counter-clockwise direction with respect to stationary gripping handle 18, pawl 21 engages the teeth of driver bevel gear 12 to again rotate this driver gear and drive stud 10 in a counter-clockwise direction. If reversal of the driving stroke is desired, the relative orientation of pawls 21 and 23 may be switched, thereby causing relative movement between U-shaped handle 2 and gripping handle 18 to cause drive stud 10 to rotate in a clockwise direction.

Figure 4:
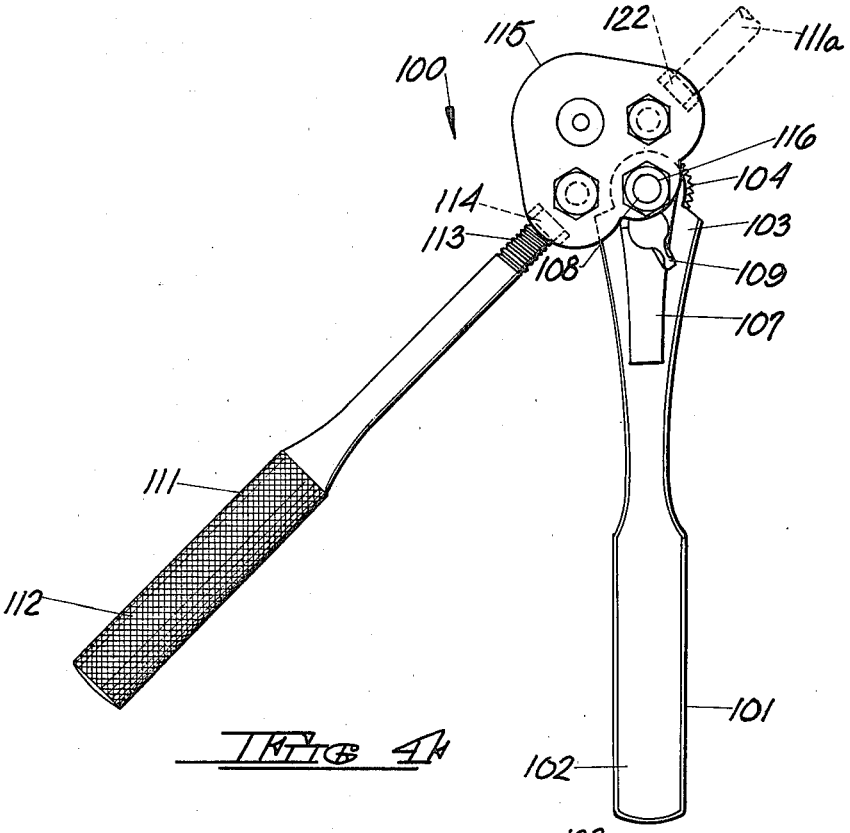
FIG. 4 is a top plan view of a second embodiment of the unidirectional drive wrench of the present invention.
Figure 5:
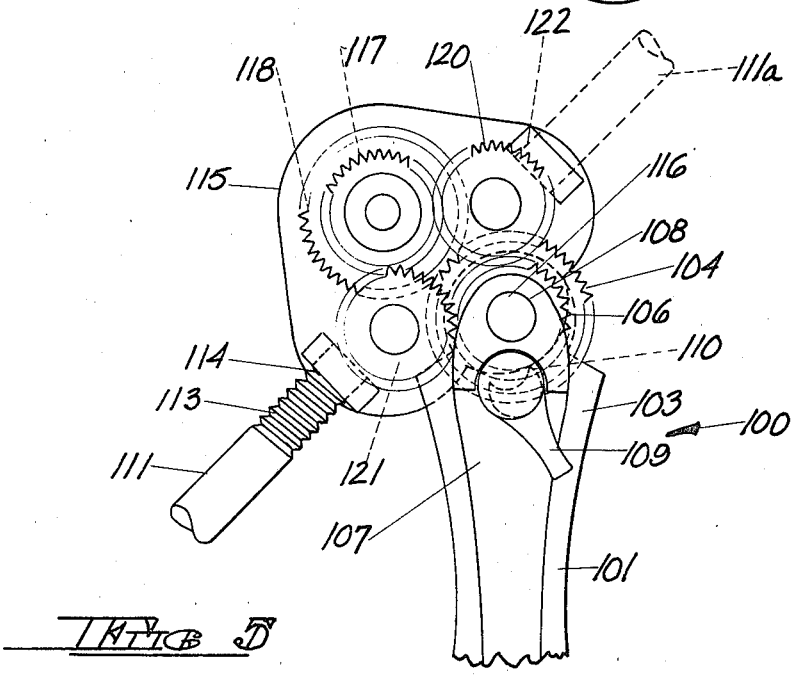
FIG. 5 is a fragmentary enlarged top plan view of the gear train of the wrench of FIG. 4.
Figure 6:
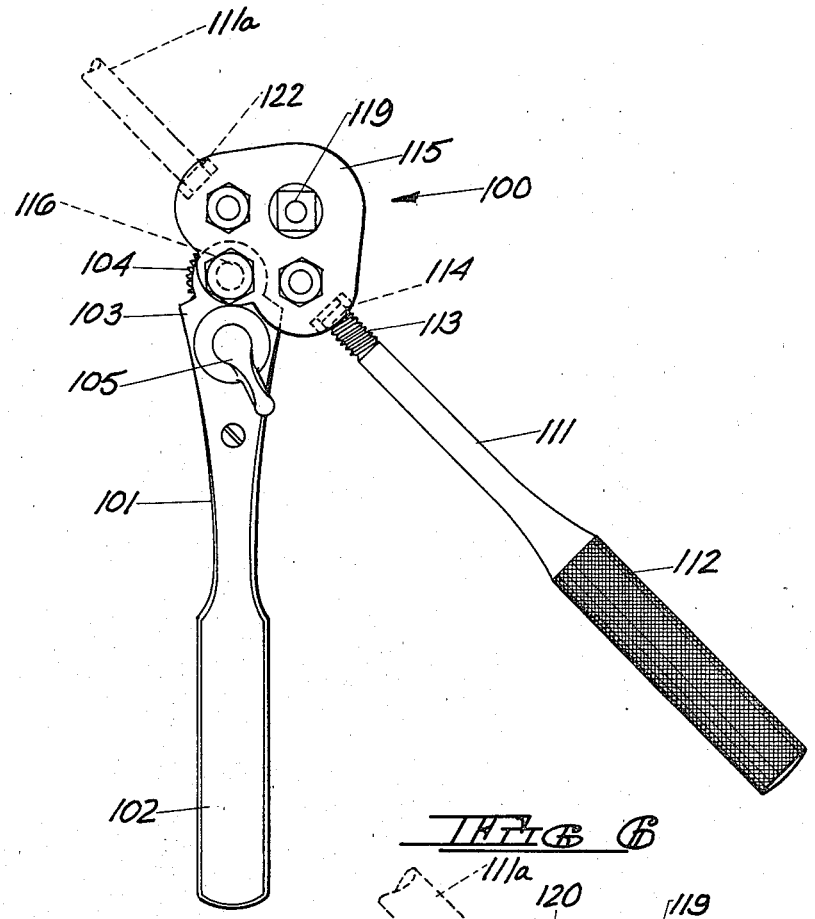
FIG. 6 is a bottom plan view of the wrench of FIG. 4.
Figure 7:
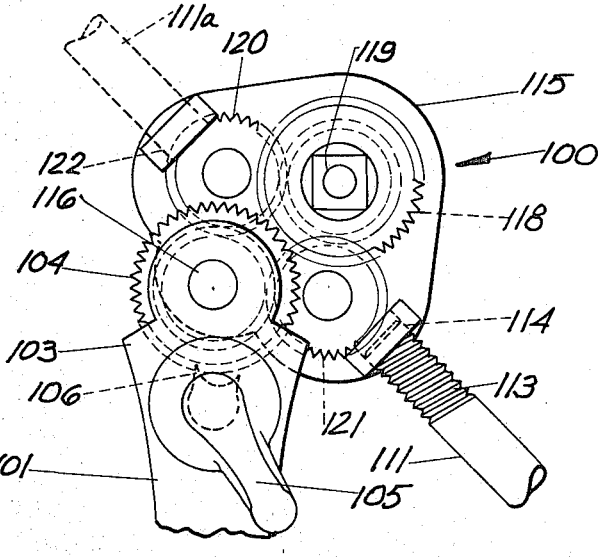
FIG. 7 is a fragmentary enlarged bottom plan view of the gear train of the wrench of FIG. 4.

A second embodiment of the present invention is illustrated generally at 100 in FIG. 4-FIG. 8. In this arrangement, a first elongated handle 101 includes a gripping portion 102 at one end, and an outwardly tapering gear mounting portion 103 at the opposite end. As best shown in FIG. 5 and FIG. 7, the upper surface of tapered portion 103 contains a recess for rotatably mounting a first driver spur gear 104. The lower surface of tapered portion 103 is provided with a shiftable latch-like lower pawl 105 containing a ratchet-like catch 106 for permitting rotation of first driver spur gear 104 in one direction but preventing rotation of the gear in the opposite direction. For example, in the orientation illustrated in FIG. 7, lower pawl 105 will permit rotation of first driver spur gear in a counter-clockwise direction but prevent rotation of the gear in a clockwise direction. Similarly, when lower pawl 105 is shifted to the left, first driver spur gear 104 may be rotated in a clockwise direction as viewed in FIG. 7, but prevented from being rotated in a counter-clockwise direction.

A second upper driver spur gear 106 is rotatably mounted coaxial with and overlying first spur gear 104. It will be observed that gear 106 is of slightly smaller diameter than gear 104 and rotates independently therefrom. Gear 106 is held in place by means of a clamping member 107 secured to the upper surface of the tapered portion 103 of first handle 101. Clamping member 107 contains a central bearing aperture 108 configured to accept a boss extending outwardly from upper driver spur gear 106 to securely but rotatably hold the gear in place.

Clamping member 107 is provided with a shiftable upper pawl 109 containing a catch 110 permitting second driver spur gear 106 to rotate in one direction but preventing rotation of the gear in the opposite direction in a manner similar to that described hereinbefore with respect to the operation of lower pawl 105 and first driver spur gear 104. As best shown in FIG. 5, with upper pawl 109 adjusted to the right, catch 110 engages the teeth of second driver spur gear 106 to permit rotation only in a counter-clockwise direction. Conversely, when upper pawl 109 is adjusted to the left, catch 110 will engage the teeth of upper driver spur gear 106 in such a way as to permit only clockwise rotation of the gear. As will be explained in more detail hereinafter, in normal operation, lower pawl 105 and upper pawl 109 will be adjusted to permit rotation of first driver spur gear 104 and second driver spur gear 106, respectively, in opposite directions.

Wrench 100 also includes a second handle 110 terminating at one end in a knurled gripping portion 112 and at the other end in a threaded shank 113. Threaded shank 113 threadedly engages a cooperating aperture 114 positioned in the side edge of cluster gear housing member 115.

Tapered portion 103 of first handle 101 is pivotally connected to cluster gear housing member 115 as at 116. It will be observed that this arrangement permits pivotal movement between first handle 101 and second handle 111.

Cluster gear housing member 115 also mounts first and second upper and lower coaxial driven spur gears 117 and 118 which are mounted on an axis spaced from but parallel to the pivot axis forming the pivotal connection 116 between first handle 101 and second handle 111. It will be observed that upper driven spur gear 117 is slightly smaller in diameter than lower driven spur gear 118, and is non-rotatably connected thereto. Gears 117 and 118 are also non-rotatably secured to a drive stud 119 for rotation therewith similar in construction and operation to drive stud 10 described and illustrated hereinabove in connection with the embodiment of FIG. 1-FIG. 3. The gears are oriented in such a way that lower driven spur gear 118 meshes with lower driver spur gear 106.

The gear cluster is completed by a pair of spaced first and second idler spur gears 120 and 121, respectively, which are rotatably secured to cluster gear housing member 115 and mesh with upper driver spur gear 106 and upper driven spur gear 117.

In operation, with lower pawl 105 and upper pawl 109 adjusted to the right as illustrated in FIG. 6 and FIG. 4, relative angular displacement between handles 101 and 111 in either direction causes drive stud 119 to rotate only in the counter-clockwise direction. Consequently, driving torque may be supplied to the drive stud in both directions of movement of the operating handles. Conversely, when both pawls are reversed or adjusted to the leftmost position, relative angular displacement between the handles in either direction causes drive stud 119 to rotate in only the clockwise direction as viewed from above.

For additional ease of operation, an additional threaded aperture 122 may be provided in cluster gear housing member 115 opposite threaded aperture 114 into which the threaded shank 113 of handle 111 may be secured as illustrated at 111*a* to permit either right-handed or left-handed operation of the wrench.

It will be understood that various changes in the details, materials, steps and arrangements of parts, which have been herein described and illustrated in order to explain the nature of the invention, may be made by those skilled in the art within the principle and scope of the invention as expressed in the appended claims.

For example, while for purposes of an exemplary showing in the first embodiment of wrench 1, drive stud 10 has been described and illustrated as an integral part of support shaft 6, it will be understood that the device may be modified. In one alternate arrangement, drive stud 10 may be connected directly to first bevel gear 12, while gears 12 and 14 are rotatably attached to support shaft 6. Furthermore, support shaft 6 would be non-rotatably connected to driver member 16.

In addition, it will be understood that upper driven spur gear 117 and lower driven spur gear 118 may be formed as a single integral gear, rather than as separate non-rotatably connected gears.

Figure 3:
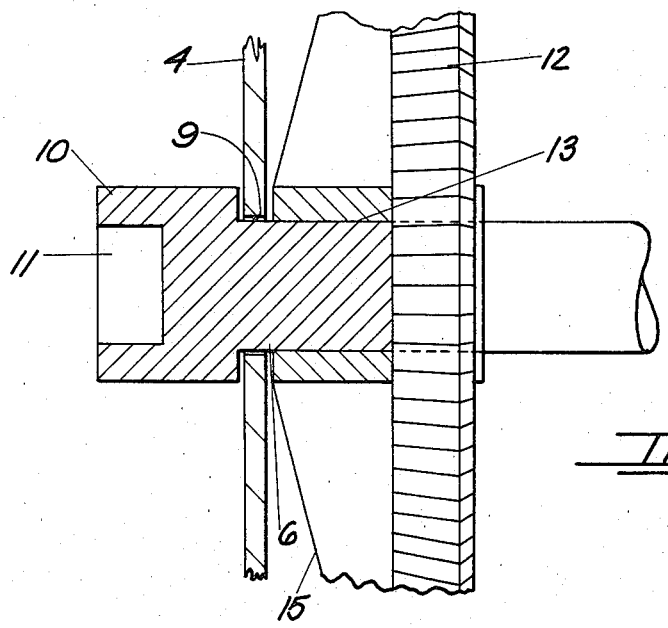
FIG. 3 is an enlarged fragmentary partially cross-sectioned view of the drive stud portion of the wrench of FIG. 1.
Figure 8:
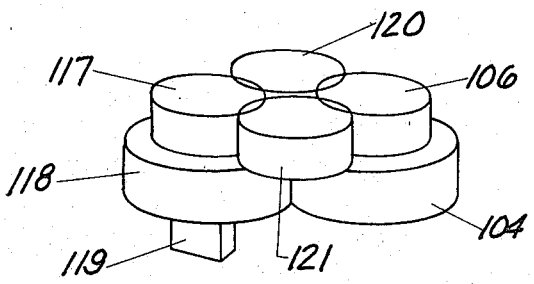
FIG. 8 is a diagrammatic perspective view of the gear train of the wrench of FIG. 4.

It will be further understood that the unidirectional wrench of the first embodiment illustrated in FIG. 1-FIG. 3 may be utilized as a conventional ratchet wrench by aligning gripping handle 18 within U-shaped handle 2 so that the wrench may be operated with one hand.

The embodiments of the invention in which an exclusive property or priviledge is claimed are as follows:

1. A unidirectional drive hand operated wrench comprising:

first and second pivotally connected angularly displaceable elongated handles;

a rotatable drive stud;

drive means connecting said handles to said drive stud such that manual angular displacement of said handles with respect to each other in either direction causes unidirectional rotation of said drive stud;

reversing means associated with said drive means for reversing the unidirectional rotation of said drive stud;

said first handle comprising a pair of spaced arms and said second handle including a gripping portion positionable between the spaced arms of said first handle when said handles are co-linear, said wrench further including a shaft rotatably supported between said arms, said second handle including a shaft-like driver member connected to said gripping portion and rotatably supported by said shaft, a first driver bevel gear rotatably mounted on said shaft between said drive member and one of said arms, a second driver bevel gear non-rotatably mounted on said shaft between said drive member and the other of said arms, said drive stud being connected to one of said gears for rotation therewith, a bevel pinion gear rotatably mounted on said driver member on either side of said shaft, said pinion gears meshing with said bevel gears, said reversing means including pawl means for permitting rotation of each of said bevel gears in only one direction.

2. The wrench according to claim 1 wherein said drive means comprises first and second oppositely rotatable drive gears, said first gear being non-rotatably secured to said drive stud for rotation therewith, said reversing means including pawl means for permitting rotation of each of said gears in only a single direction, said pawl means being shiftable to permit rotation of the associated gear in only the opposite direction to reverse the unidirectional rotation of said drive stud.

3. The wrench according to claim 1 wherein said pawl means comprises a pawl secured to each of said arms and contacting the adjacent bevel gear, each of said pawls being manually shiftable to a first position to permit rotation of the associated bevel gear in only a single direction, each of said pawls being shiftable to a second position to permit rotation of the associated bevel gear in only the opposite direction.

4. The wrench according to claim 3 wherein said drive stud forms a part of said shaft.

5. A unidirectional drive hand operated wrench comprising:

first and second pivotally connected angularly displaceable elongated handles;

a rotatable drive stud;

drive means connecting said handles to said drive stud such that manual angular displacement of said handles with respect to each other in either direction causes unidirectional rotation of said drive stud; and reversing means associated with said drive means for reversing the unidirectional rotation of said drive stud; said drive means comprising first gear means rotatably mounted to said first handle, second gear means rotatably mounted to said second handle and means connecting said first and second gear means for causing unidirectional rotation of said drive stud upon angular displacement of said handles in either direction.

6. The wrench according to claim 5 wherein said first gear means comprises first and second independently rotatable coaxial driver spur gears, said second gear means comprises a driven spur gear meshing with said second driver spur gear, and said connecting means comprises spaced idler gears meshing with said second driver gear and said driven gear, said reversing means comprising pawl means for permitting rotation of said first and second driver gears in one direction only.

7. The wrench according to claim 6 wherein said pawl means comprises first and second pawls secured to said first handle, each of said pawls being manually shiftable to a first position to permit rotation of the associated driver spur gear in only a single direction, each of said pawls being shiftable to a second position to permit rotation of the associated driver spur gear in only the opposite direction.

8. The wrench according to claim 6 wherein said drive stud is non-rotatably secured to said driven gear for rotation therewith.

9. The wrench according to claim 5 wherein said second handle includes a manual gripping portion and means for removing said gripping portion from said second handle and reattaching said gripping portion to a position angularly disposed therefrom to permit right-hand or left-hand operation.

* * * * *